US006508424B1

(12) United States Patent
Marshall

(10) Patent No.: US 6,508,424 B1
(45) Date of Patent: Jan. 21, 2003

(54) BATTERY OPERATED PILL CRUSHER

(76) Inventor: Joyce Marshall, 53 Vermilon La., Levittown, PA (US) 19054

( * ) Notice: Subject to any disclaimer, the term of this patent is extended or adjusted under 35 U.S.C. 154(b) by 173 days.

(21) Appl. No.: 09/648,882

(22) Filed: Aug. 25, 2000

(51) Int. Cl.[7] ..... B02C 19/08

(52) U.S. Cl. ..... 241/169.1; 241/169.2; 241/DIG. 27

(58) Field of Search ..... 241/168, 169.1, 241/169.2, DIG. 27

(56) References Cited

U.S. PATENT DOCUMENTS 4,765,549 A * 8/1988 Sherman ..... 241/DIG. 27

* cited by examiner

*Primary Examiner*—Mark Rosenbaum
(74) *Attorney, Agent, or Firm*—John D. Gugliotta

(57) ABSTRACT

A battery operated pill crusher is provided having a motorized, rotating plunger in a portable configuration.

7 Claims, 3 Drawing Sheets

BATTERY OPERATED PILL CRUSHER

RELATED APPLICATIONS

The present invention was first described in Disclosure Document No. 443,168, filed on Jul. 30, 1998. There are no previously filed, nor currently any co-pending applications, anywhere in the world.

BACKGROUND OF THE INVENTION

1. Field of the Invention

The present invention relates generally to portable, battery powered pill crushers and splitters and, more particularly, to a battery operated pill crusher having a motorized, rotating plunger in a portable configuration.

2. Description of the Related Art

Modern medicine has taken great strides over the years, producing cures and treatments for thousands of diseases, many of which were at one time incurable or uncontrollable. Attacking these ailments from a variety of angles, some of the greatest achievements made along these lines are in the area of medications and both prescription drugs and over-the-counter drugs. Simply by taking a pill, one can be relieved or cured of a variety of ailments ranging from the common cold to rare and exotic diseases. However, many people experience extreme difficulty in swallowing pills whole and are forced to crush them, allowing them to ingest the pill in combination with food or drink. While this procedure is often effective, the process of crushing the pill can be difficult for many and also can result in losing the medication as the crushing takes place.

A search of the prior art did not disclose any patents that read directly on the claims of the instant invention; however, the following references were considered related.

The following patents describe pill-crushing, top-mounted cups for storing and/or dispensing:

U.S. Pat. No. 5,618,004 issued in the name of Klearman et. al.

U.S. Pat. No. 2,892,595 issued in the name of Tupper

U.S. Pat. No. D 337,828 issued in the name of Gordon

The following patents disclose various hand-held pill or tablet pulverizers:

U.S. Pat. No. 5,531,386* issued in the name of Jensen

U.S. Pat. No. 5,178,337* issued in the name of Lupoli

U.S. Pat. No. 5,123,601* issued in the name of Lavin et. al.

U.S. Pat. No. 4,366,930* issued in the name of Trombetti et. al.

U.S. Pat. No. D 285,966* issued in the name of Porter

The following two patents describe a mortar and pestle assembly for grating pills:

U.S. Pat. No. 4,967,971 issued in the name of Smith; and

U.S. Pat. No. 4,003,523 issued in the name of Doolittle

And, U.S. Pat. No. 5,067,666 issued in the name of Sussman describes power-driven portable pill pulverizer.

Consequently, a there is a need for a means by which one can crush pills easily, effectively and without losing any part of the medication dosage.

SUMMARY OF THE INVENTION

Therefore, it is an object of the invention to provide for to a battery operated pill crusher by which one can crush pills easily, effectively and without losing any part of the medication dosage.

It is a feature of the present invention to provide a battery powered pill crusher having a motorized, rotating plunger in a portable configuration.

Briefly described according to one embodiment of the present invention, a small mill-type device is provided that is used to crush solid pills or tablets. The device includes a small mill-type mechanism, similar in nature to that of a I pepper mill, that is used to grind the pills into a granular consistency. The pill or pills are inserted in the top of the device and ground in the mill, the crushed pills being deposited in a reservoir in the bottom of the device. The reservoir is removable and provides a convenient manner by which to pour the ground pills into the food or drink being used as a carrier to ingest the drug. Available in both battery powered and hand cranked models, the device is completely submersible, allowing it to be cleaned between uses in order to prevent contamination between different drugs.

As a result, use of the present invention makes taking medications an easy pill to swallow.

An advantage of the present invention is that it reduces lost medications in the pulverizing process.

Another advantage of the present invention is that it makes it easy to ingest medications.

Yet another object of the present invention is that it provides a reservoir which stores crushed pill.

It is yet another object of the present invention to provide such a device that is completely submersible for easy and effective cleaning.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
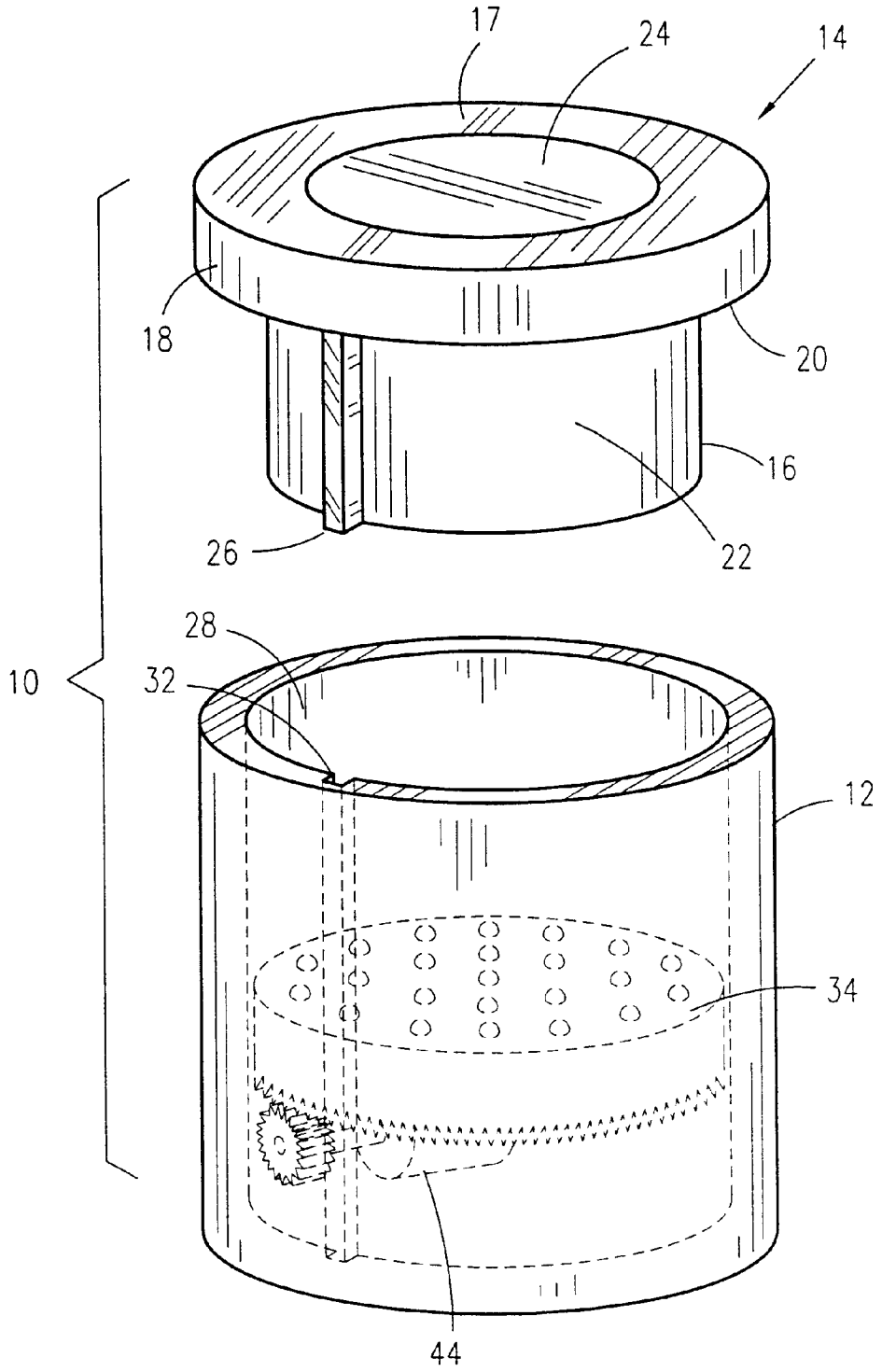
FIG. 1 is a partially exploded, diagrammatical and perspective view of a battery operated pill crusher according to the preferred embodiment of the present invention.

Referring now to FIGS. 1–4, a battery operated pill crusher 10 is shown, according to the present invention, having a lower container 12 and plunger 14. The plunger 14 is generally cylindrical, having a lower protrusion shaft 16 extending downwardly from a cap 17 having an upper gripping circumference 18. The diameter of the upper gripping circumference 18 is greater than that of the lower protrusion shaft 16 such as to create a stop ridge 20 there between. Although not an essential element of the present teachings, the plunger 14 is envisioned as forming an internal storage volume 22 sealed by a removable lid 24. The protrusion shaft 16 forms a generally cylindrical, smooth sidewall having a guide key 26 extending outwardly in a vertical, linear fashion.

The lower container 12 forms an inner volume 28 that receives the protrusion shaft 16 of the plunger 14. The inner volume 28 forms a generally cylindrical, smooth sidewall having a keyway 32 extending radially outwardly in a vertical, linear fashion. The keyway 32 receives and guides the key 26 when the protrusion shaft 16 is inserted into the inner volume 28. This functions both as a linear alignment guide, as well as a rotation lock to prevent the plunger 14 from twisting.

The bottom of the inner volume 28 is bounded by a turntable 34. The turntable 34 is rotatably housed within the lower portion of the container 28, and is mechanically connected to and driven by a drive mechanism as will be described below.

Figure 2:
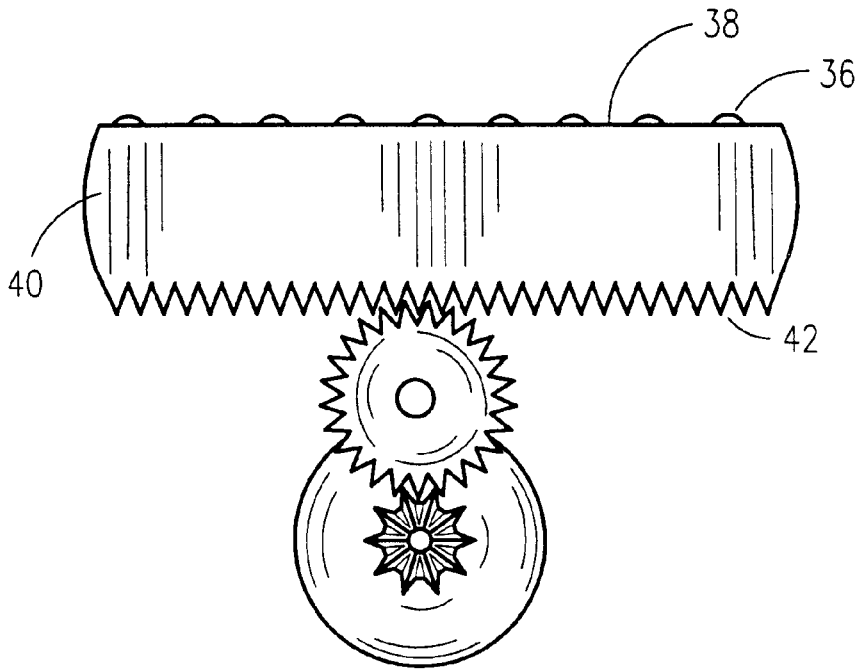
FIG. 2 is a partial side elevational view of a turntable drive mechanism for use therewith.
Figure 3:
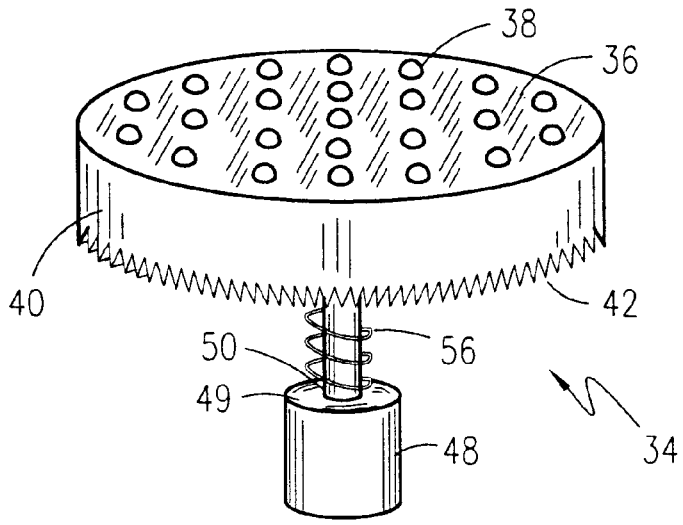
FIG. 3 is a partial perspective view a turntable actuation mechanism thereof.

As best shown in conjunction with FIG. 2 and FIG. 3, the turntable 34 is shown in greater detail. The turntable 34 is formed as a disc shaped member having a rounded outer perimeter. An upper surface 36 is generally horizontally planar and supports a plurality of grinding protrusions 38 formed as rigid extensions for increasing surface area and friction, as well as concentrating vertical forces. A seal is formed between the outer circumference of the turntable 34 and the inner cylindrical surface of the inner volume 28. Although many methods of generating a seal between rotating or moving parts, for purposes of disclosure such sealing method for use with the preferred embodiment consists of a concave outer curvature 40 extending along the outer circumferential sidewall 42 of the turntable member 34. Alternately, the use of a flexible sealing ring, or "O" ring, or other such method could be equally as effective. The outer circumferential sidewall 42 extends downward about the upper surface 36, forming a drive skirt 40 terminating at the lower end in a series of radially aligned detents 42. Each detente 42 forms a drive gear cut at an 45 degree angle inward for engagement with the drive mechanism.

Figure 4:
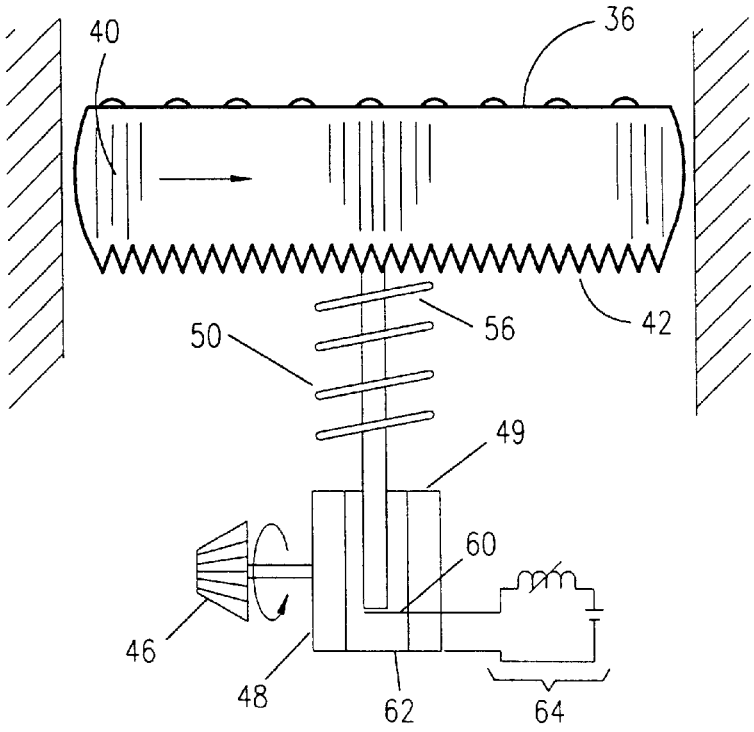
FIG. 4 is aside diagrammatical elevational view of the turntable actuation mechanism of FIG. 3.

According to the preferred embodiment of the present invention and in conjunction with FIG. 4, a drive mechanism comprising an electric motor 44 driving a drive gear 46 is contained within the container 12 beneath the turntable 34. The drive gear 56 is cut at a 45 degree angle, and is positioned upward for engagement with the detents 42. An electrical power source, whether by battery or conventional AC plug, is envisioned as powering the electric motor 44 in an otherwise conventional manner.

As best shown in FIG. 3 and FIG. 4, the turntable 34 is rotated about a center, vertical hub 56 which functions as an axle. The hub 56 is supported at its lower end by a guide collar 48 in a vertically slidable manner. The guide collar 48 supports an upper annular support 49 that supports a turntable resistance spring 50. The turntable resistance spring 50 functions to provide an upward urging force between the turntable 34 and the bottom of the container 12. The lower portion of the hub 56, when depressed, urges a first contact 60 against a second contact 62 such as to complete the electric drive circuit 64 engage the electric motor 44

Figure 5:
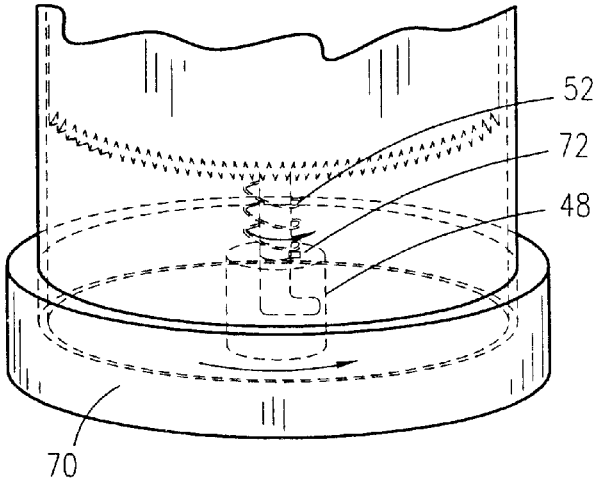
FIG. 5 is a partially exploded, diagrammatical and perspective view of a manually operated pill crusher according to an alternate embodiment of the present invention.

Referring now to FIG. 5, the teachings of the present disclosure are further shown in conjunction with a manually operated pill crusher according to an alternate embodiment of the present invention. As such, the drive mechanism incorporating the electric motor 44 and drive gear 46 are replaced with a lower hand cap 70 rotatable supported on the bottom of the container 12. The guide collar 48 is in mechanical communication with the cap 70, such that when the lower hand cap 70 is rotated the guide collar 48 rotates as well. A vertical hub engagement means 72, hearing shown as a tabbed key 74 aligned with a second keyway 76 within the guide collar 48, allow the mechanical communication of rotational torque to be applied from the lower cap 70 to the turntable 34 upon overcoming the urging force of the spring 50.

2. Operation of the Preferred Embodiment

To use the present invention, a user can employ the storage volume 22 for retention and dispensing of medications. Upon selection and removal, a pill type medication can be placed within the inner volume 28. The plunger 14 is thereafter inserted into the inner volume, and pressed down against the upward urging force of the turntable spring 50. As the protrusion shaft descends, the medication is impinged between the protrusion shaft and the upper surface 36 of the turntable 34. As the protrusion shaft descends further, the turntable is pushed downward, forcing the center hub 56 downward as well. As the electrical contacts 60, 62 contact, the drive gear 46 simultaneously engages with the detents 42. Further, electrical continuity is achieved and the drive motor 44 causes the drive gear 46 to rotate, translating this motion to the turntable 34. As rotational motion is applied as well as compression, any pill type medication is pulverized between the turntable and plunger, as well as about the grinding protrusions 38. Upon completion, removal of the plunger 14 allows for pulverized medication to be released from the inner volume 28.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A pill crusher comprising:

a lower container;

generally cylindrical plunger having a lower protrusion shaft extending downwardly from a cap having an upper gripping circumference, wherein the diameter of the upper gripping circumference is greater than that of the lower protrusion shaft such as to create a stop ridge there between, wherein said protrusion shaft forms a generally cylindrical, smooth sidewall having a guide key extending outwardly in a vertical, linear fashion; and an internal storage volume formed by said plunger and sealed by a removable lid.

2. The pill crusher of claim 1, wherein said lower container forms an inner volume that receives the protrusion shaft of the plunger, said inner volume forming a generally cylindrical, smooth sidewall having a keyway extending radially outwardly in a vertical, linear fashion, said keyway receiving and guiding the key when the protrusion shaft is inserted into the inner volume, thereby functioning both as a linear alignment guide, as well as a rotation lock to prevent the plunger from twisting.

3. The pill crusher of claim 2, wherein a bottom of the inner volume is bounded by a turntable, said turntable rotatably housed within the lower portion of the container and mechanically connected to and driven by a drive mechanism.

4. The pill crusher of claim 3, wherein said turntable is formed as a disc shaped member having a rounded outer perimeter, an upper surface being generally horizontally planar and supporting a plurality of grinding protrusions formed as rigid extensions for increasing surface area and friction, as well as concentrating vertical forces, and a seal formed between the outer circumference of the turntable and the inner cylindrical surface of the inner volume.

5. The pill crusher of claim 4, wherein the outer circumferential sidewall extends downward about the upper surface, thereby forming a drive skirt terminating at the lower end in a series of radially aligned detents, wherein each detente forms a drive gear cut at an 45 degree angle inward for engagement with said drive mechanism.

6. The pill crusher of claims 5, wherein said drive mechanism comprises an electric motor driving a drive gear contained within said container beneath said turntable, said drive gear cut at a 45 degree angle upward for engagement with said detents.

7. The pill crusher of claim 5, wherein said turntable is rotated about a center, vertical hub which functions as an axle, said hub supported at its lower end by a guide collar in a vertically slidable manner and said guide collar supporting an upper annular support that supports a turntable resistance spring.

* * * * *